US010465878B2

(12) United States Patent
Koehler et al.

(10) Patent No.: US 10,465,878 B2
(45) Date of Patent: Nov. 5, 2019

(54) LED-BASED CLEAN ROOM LIGHTING

(71) Applicant: LEDVANCE GmbH, Garching bei Muenchen (DE)

(72) Inventors: Melanie Koehler, Friedberg (DE); Armin Konrad, Grossaitingen (DE)

(73) Assignee: LEDVANCE GMBH, Garching Bei Munich (DE)

( * ) Notice: Subject to any disclaimer, the term of this patent is extended or adjusted under 35 U.S.C. 154(b) by 0 days.

(21) Appl. No.: 15/680,783

(22) Filed: Aug. 18, 2017

(65) Prior Publication Data

US 2018/0051864 A1 Feb. 22, 2018

(30) Foreign Application Priority Data

Aug. 18, 2016 (DE) ..... 10 2016 115 376

(51) Int. Cl.

| | |
|---|---|
| ***F21V 23/00*** | (2015.01) |
| ***F21V 9/00*** | (2018.01) |
| ***F21K 9/275*** | (2016.01) |
| ***F21V 23/04*** | (2006.01) |
| *F21Y 103/10* | (2016.01) |
| *F21Y 115/10* | (2016.01) |
| *F21Y 113/13* | (2016.01) |

(52) U.S. Cl.
CPC ..... *F21V 9/00* (2013.01); *F21K 9/275* (2016.08); *F21V 23/0435* (2013.01); *F21V 23/003* (2013.01); *F21Y 2103/10* (2016.08); *F21Y 2113/13* (2016.08); *F21Y 2115/10* (2016.08)

(58) Field of Classification Search
None
See application file for complete search history.

(56) References Cited

U.S. PATENT DOCUMENTS

2010/0195322 A1* 8/2010 Kawakami ..... F21S 2/00 362/231

* cited by examiner

*Primary Examiner* — Christle I Marshall
(74) *Attorney, Agent, or Firm* — Hayes Soloway PC

(57) ABSTRACT

A lighting device for room lighting in photolithography applications (in particular a retrofit lamp in sizes T5 and T8) comprises a light engine having a first light source which is configured to emit light in the wavelength range above approximately 500 nm and a second light source which is configured to emit light in a different wavelength range from the first light source. The first light source produces light in a spectral range within which photoresists used in photolithography are not sensitive. The second light source produces white light (either alone or in combination with the first light source).

20 Claims, 1 Drawing Sheet

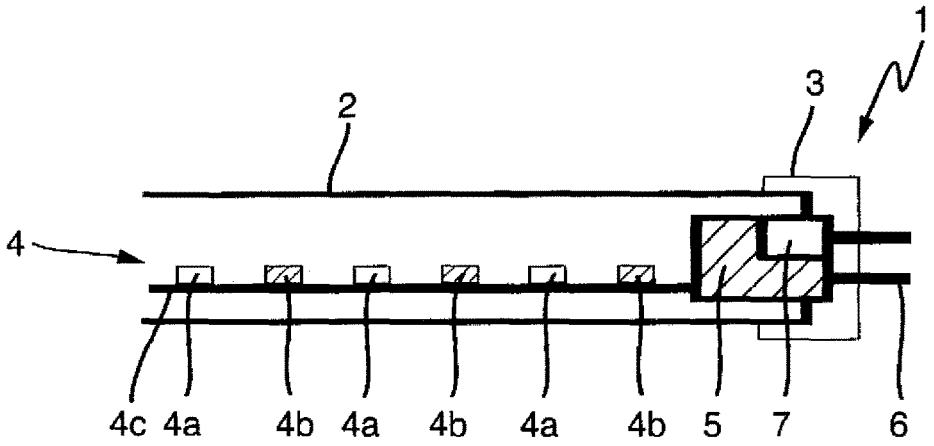
1
2
3
4
4c
4a
4b
4a
4b
4a
4b
5
7
6

LED-BASED CLEAN ROOM LIGHTING

TECHNICAL FIELD

The present invention relates to a lighting device for room lighting in photolithography applications. The invention relates in particular to a retrofit lamp in tube form.

PRIOR ART

For lighting purposes in photolithography applications, particularly under clean room conditions, fluorescent lamps (fluorescent tubes, gas discharge tubes) are used with filter sleeves attached to the outside. In particular, the filter sleeve absorbs the spectral components from the light of the fluorescent lamp to which the photoresist used in photolithography is sensitive, i.e. the wave lengths which the photoresist absorbs, thereby curing the photoresist. Many photoresists currently in use are especially highly absorbent in the emission lines of mercury vapour lamps, particularly at 435 nm, 405 nm, and 365 nm. Some more modern photoresists are also absorbent, particularly below approximately 380 nm.

For this reason, the material of the filter sleeve is chosen so that there is no or almost no emission of light below approximately 500 nm. The fluorescent lamps with filter sleeve therefore usually produce yellow light for room lighting.

However, yellow room lighting is not optimal, particularly for maintenance work. Therefore, additional white, "neutral" room lighting is often provided which can be used during the maintenance work or also when "neutral" lighting is necessary for other reasons. In this case, it must be ensured that the white lighting cannot be switched on inadvertently while photolithography applications are being carried out in order to prevent unintentional exposure of the photoresist.

As an alternative to separate white lighting, the yellow fluorescent lamps can be exchanged for white lamps before maintenance work. After completing the maintenance work, a further exchange must be carried out back to the yellow lamps. However, depending on the number of lamps, this results in considerable additional expenditure in terms of both time and cost.

PRESENTATION OF THE INVENTION

Based on the known prior art, it is an object of the present invention to provide an improved lighting device for room lighting in photolithography applications which eliminates or at least reduces the problems described above.

This object is achieved according to the invention by a lighting device having the features of the independent claim. Advantageous developments emerge from the dependent claims.

A lighting device according to the invention for room lighting in photolithography applications comprises a housing that is at least partially transparent and/or translucent. A light engine for producing light is arranged inside the housing. The light engine comprises at least one first light source and at least one second light source. The at least one first light source (referred to hereafter for the sake of simplicity as the first light source) is configured to emit light substantially only in the visible wavelength range above approximately 500 nm. The first light source should thus emit almost no light in the wavelength range below approximately 500 nm. The range between 380 nm and 780 nm is deemed the visible wavelength range. Conventional gas discharge lamps with filter sleeve, such as are used for room lighting in photolithography applications, typically emit less than 5 mW/1000 lm, preferably less than 2 mW/1000 lm, further preferably less than 0.5 mW/1000 lm, especially preferably less than 0.05 mW/1000 lm in the wavelength range below approximately 500 nm. Light in the wavelength range above approximately 500 nm is particularly suitable for room lighting during photolithography applications as photoresists are usually not sensitive or hardly sensitive in this range.

The at least one second light source (referred to hereafter for the sake of simplicity as the second light source) is configured to emit light in a different wavelength range from the first light source. Light of the second light source can be used (alone or in combination with light of the first light source) for room lighting in situations when lighting in the wavelength range above approximately 500 nm is not desirable or suitable, e.g. during maintenance work.

The first light source and/or the second light source can preferably each comprise at least one light-emitting diode (LED).

In a preferred embodiment, the first light source is configured to produce light in the wavelength range above approximately 500 nm. This means that the light produced directly (i.e. without subsequent filtering) by the light source (e.g. the LED) is almost exclusively in the wavelength range above approximately 500 nm. For example, light-emitting diodes which produce light (almost) exclusively in the wavelength range above approximately 500 nm can be used as the first light source.

Alternatively, the at least one first light source can be provided with a filter which absorbs light in the wavelength range below approximately 500 nm. The light produced directly by the light source (e.g. the LED) can then also be at least partially in the wavelength range below approximately 500 nm, these spectral components being absorbed by the filter. In this case, for example, light-emitting diodes which emit white light that is subsequently filtered can be used as the first light source so that only light in the wavelength range above approximately 500 nm is emitted by the first light source.

Of course, a first light source, whose emission spectrum is exclusively or predominantly in the wavelength range above approximately 500 nm, can also be provided additionally with such a filter. As a result, the emission spectrum can be further optimised and adapted to the requirements as required.

For example, LEDs which are sold by OSRAM under the name OSLON LY CP7P can be used as the first light source. These InGaAlP-technology based LEDs are particularly efficient in the wavelength range above approximately 500 nm and particularly in the spectral range yellow to orange. The OSLON LY CP7P, for example, has an emission wavelength of 597 nm with a width at half maximum of 16 nm. The radiation fraction in the wavelength range below 500 nm is then less than approximately 0.01%.

The first light source can also be an LED which emits shorter wave (e.g. blue) light that is then converted into light in the wavelength range above approximately 500 nm (e.g. yellow or orange) by means of a fluorescent substance (e.g. phosphor). The rare-earth doped garnets are a particularly well-known phosphor family. For example, but not exclusively, reference is made here to the compound Y3Al15OO112:Ce(0.12). If necessary, any spectral components still present in the wavelength range below approximately 500 nm can then be removed with a filter.

During operation of the lighting device in photolithography applications, the lighting device is controlled such that only the first light source produces light which is then, either directly or because of the filter, in a wavelength range in which the photoresists normally used in photolithography applications are not sensitive.

The second light source of the lighting device according to the invention is used, for example, to achieve neutral (white) lighting during maintenance work. White light here is understood as light which is perceived as white by humans because of its spectral composition. As is known, there are various shades, such as warm white, cold white, daylight, etc., all of which are understood here as white light.

In a preferred embodiment, the second light source is configured to emit substantially white light. For this purpose, for example, an LED can be used which produces blue light that is then converted partially into light of a higher wave length by means of a fluorescent substance (e.g. phosphor). White light is then created by mixing these spectral components. Such a conversion-based LED is represented, for example, by the OSRAM OS DURIS® E 5 GW JDSRS1.EC-FTGP-5C8E-L1N2 with a colour temperature of around 6500 Kelvin.

Alternatively, the second light source can be configured to emit light in a wavelength range which is selected such that the mixture of the light emitted by the first light source and the light emitted by the second light source results in substantially white light. Thus if the first light source emits substantially yellow light, the second light source, for example, can be chosen such that it emits blue light. With a sufficiently large distance from the light sources, the mixture of light then appears as white. Of course, other light colours (and in particular more than two colours) can also be mixed to obtain white light. A blue-emitting LED OSRAM OS DURIS® P 5 GD DASPA1.14-RLRN-W5-1 is mentioned here as an example.

In a preferred embodiment, the lighting device comprises at least one driver for controlling the first light source and the second light source.

The driver can be configured to control the first light source and the second light source each individually and/or together. In particular, the driver can comprise a first driver for controlling the first light source and a second driver for controlling the second light source. Both drivers can switch the respectively associated light source on and off. In addition, it can be provided that both drivers can dim the respectively associated light source. Furthermore, both drivers can communicate with each other, e.g. to switch off the first light source when the second light source is switched on.

Instead of two separate drivers, a single driver can also be provided which can control both light sources, i.e. can switch them on and off and dim them if necessary.

The driver (both as a single driver and also as two drivers) can be configured to set the required switching states of the two light sources. In this case, a first switching state can be that the first light source is switched on and the second light source is switched off. As a result, the light engine produces light in the wavelength range above approximately 500 nm.

A second switching state can be that the first light source is switched off and the second light source is switched on. This switching state is used in particular if the second light source emits white light.

One alternative for the second switching state can be that both the first light source and also the second light source are switched on. This switching state is used in particular if the second light source emits light that results in white light when mixed with light emitted by the first light source. If necessary, in this switching state one of the two light sources (in particular the first light source) can be dimmed to obtain the desired colour mixture.

In a third switching state, both light sources can be switched off.

The desired switching state can be selected via a control unit and can be transmitted by it to the driver.

In a preferred embodiment, the driver comprises a wireless communication device. The control unit can tell the driver, via the wireless communication device, which switching state of the light sources should be set. The wireless communication device can also be executed separately from the driver and can communicate with the driver via an interface.

Any known protocol, for example WLAN, Bluetooth or any other wireless protocol, can be used for the wireless communication.

Instead of wireless communication with the driver, communication between control unit and driver can also be wired, for example by means of known circuit technology.

In a preferred embodiment, the housing of the lighting device comprises a cylindrical glass tube. The lighting device can be designed in particular as a so-called retrofit lamp (i.e. to replace conventional lamps) in particular of the T5 and T8 designs.

BRIEF DESCRIPTION OF THE FIGURES

Preferred further embodiments of the invention will be explained in greater detail using the following description of the FIGURES. In this case the drawings show:

FIG. 1 a schematic representation of an embodiment of a lighting device according to the invention.

DETAILED DESCRIPTION

Preferred embodiments are described below based on the FIGURES. In this case, identical, similar or equivalent elements are provided with the same reference numbers in the different FIGURES and repeated description of these elements is partly omitted to avoid redundancies.

FIG. 1 shows a schematic detail from a cross-section through a first embodiment of a lighting device 1 according to the invention. The lighting device 1 is an LED retrofit tubular lamp of size T8. The invention can also be used, however, with lighting devices of other sizes (e.g. T5) and other designs.

The lighting device 1 comprises a glass bulb 2 which is provided at both ends (only one end shown here) with an end cap 3 and is fused therewith. Located inside the glass bulb 2 is the light engine 4 which consists of a plurality of light-emitting diodes 4*a* of a first light source and a plurality of light-emitting diodes 4*b* of a second light source that are arranged on a printed circuit board 4*c*. The light-emitting diodes 4*a* of the first light source emit light substantially in the wavelength range above approximately 500 nm. The light-emitting diodes 4*b* of the second light source emit substantially white light.

The light-emitting diodes 4*a* and 4*b* are controlled by an electronic driver 5. The driver is electrically connected with two connection pins 6. The connection pins 6 are used on the one hand for mechanically holding the lamp 1 in a socket (not shown) and on the other hand for connecting electrically to the socket.

The driver 5 is configured such that it can switch on either the light-emitting diodes 4*a* of the first light source or the light-emitting diodes 4*b* of the second light source, the light-emitting diodes of one light source being switched off if necessary when the light-emitting diodes of the other light source are switched on.

Integrated in the driver 5 is a wireless communication device 7 which can receive control commands from a control unit not shown here.

Provided on the opposing end, not shown here, of the lighting device 1 there are also two pins which are only used for mechanical holding as no driver is provided there. However, a driver 5 with electrically connected connection pins 6 can also be used at both ends of the lighting device 1, in which case each driver controls only a portion of the light-emitting diodes 4*a* and 4*b*. Alternatively, the one driver can control only the light-emitting diodes 4*a* of the first light source and the other driver only the light-emitting diodes 4*b* of the second light source. In the case of separate drivers for both light sources, they can also both be arranged on the same side of the lighting device 1.

Although the invention has been illustrated and described in greater detail using the embodiments shown, the invention is not limited thereto and a person skilled in the art may derive other variations therefrom without departing from the scope of protection of the invention.

Generally, "one" may be understood to mean a single FIGURE or a plurality, particularly in the sense of "at least one" or "one or more", etc., as long as this is not explicitly excluded, e.g. by the expression "exactly one".

A specified FIGURE may also include exactly the number and also a customary tolerance range, as long as this is not explicitly excluded.

Where applicable, all the individual features illustrated in the embodiments can be combined and/or replaced with each other without departing from the scope of the invention.

LIST OF REFERENCE NUMBERS

1 Lighting device
2 Glass bulb
3 End cap
4 Light engine
4*a* Light-emitting diode of the first light source
4*b* Light-emitting diode of second light source
4*c* Printed circuit board
5 Driver
6 Connection pins
7 Wireless communication device

The invention claimed is:

1. A lighting device for room lighting in photolithography applications, the lighting device comprising:
- an at least partially transparent housing;
- a light engine arranged inside said housing, wherein the light engine comprises:
  - at least one first light source configured to emit light substantially only in a wavelength range above approximately 500 nm; and
  - at least one second light source configured to emit light in a different wavelength range from the first light source;
- at least one driver internal to the lighting device and configured to control the at least one first light source and the at least one second light source such that:
  - in a first switching state of the light engine, the at least one first light source is turned on and the at least one second light source is turned off;
  - in a second switching state of the light engine, either:
    - the at least one first light source is turned off and the at least one second light source is turned on; or
    - the at least one first light source is turned on and the at least one second light source is turned on but either the at least one first light source or the at least one second light source is dimmed; and
  - in a third switching state of the light engine, the at least one first light source is turned off and the at least one second light source is turned off; and
- a control unit internal to the lighting device and communicatively coupled with the at least one driver and configured to instruct the at least one driver in operating in any of the first switching state, the second switching state, and the third switching state.

2. The lighting device according to claim 1, wherein the at least one first light source comprises at least one light-emitting diode configured to emit only light of a wavelength above 500 nm, such that the at least one first light source emits light substantially only in a wavelength range above approximately 500 nm.

3. The lighting device according to claim 1, wherein the at least one second light source comprises at least one light-emitting diode.

4. The lighting device according to claim 1, wherein the at least one second light source is configured to emit substantially white light.

5. The lighting device according to claim 1, wherein the at least one second light source is configured to emit light in a wavelength range which is selected such that the mixture of the light emitted by the first light source and the light emitted by the second light source results in substantially white light.

6. The lighting device according to claim 1, wherein the at least one driver is configured to control the at least one first light source and the at least one second light source each individually.

7. The lighting device according to claim 1, wherein the at least one driver comprises a wireless communication device.

8. The lighting device according to claim 1, wherein the housing comprises a cylindrical glass tube.

9. The lighting device according to claim 1, wherein the at least one first light source comprises:
- at least one light-emitting diode configured to emit light substantially of a wavelength above approximately 500 nm; and
- a filter downstream of the at least one light-emitting diode and configured to absorb light of a wavelength below approximately 500 nm, such that the at least one first light source emits light substantially only in a wavelength range above approximately 500 nm.

10. The lighting device according to claim 1, wherein the at least one first light source comprises:
- at least one light-emitting diode configured to emit light substantially of a wavelength below approximately 500 nm; and
- a fluorescent substance downstream of the at least one light-emitting diode and configured to convert light of a wavelength below approximately 500 nm to light of a wavelength above approximately 500 nm, such that the at least one first light source emits light substantially only in a wavelength range above approximately 500 nm.

11. The lighting device according to claim 1, wherein the at least one first light source is configured to emit less than 5 mW/1000 lm in the wavelength range below approximately 500 nm.

12. The lighting device according to claim 1, wherein the at least one first light source is configured to emit less than 2 mW/1000 lm in the wavelength range below approximately 500 nm.

13. The lighting device according to claim 1, wherein the at least one first light source is configured to emit less than 0.5 mW/1000 lm in the wavelength range below approximately 500 nm.

14. The lighting device according to claim 1, wherein the at least one first light source is configured to emit less than 0.05 mW/1000 lm in the wavelength range below approximately 500 nm.

15. The lighting device according to claim 1, wherein the at least one driver is configured to control the at least one first light source and the at least one second light source together.

16. The lighting device according to claim 1, wherein the at least one drive comprises:

a first driver configured to control the at least one first light source only; and a second driver configured to control the at least one second light source only.

17. The lighting device according to claim 1, wherein in the second switching state of the light engine, the at least one first light source is turned off and the at least one second light source is turned on.

18. The lighting device according to claim 1, wherein in the second switching state of the light engine, the at least one first light source is turned on and the at least one second light source is turned on but either the at least one first light source or the at least one second light source is dimmed.

19. The lighting device according to claim 18, wherein the at least one first light source is dimmed.

20. The lighting device according to claim 18, wherein the at least one second light source is dimmed.

* * * * *